United States Patent [19]

Hoffman

[11] 4,202,590

[45] * May 13, 1980

[54] INTERLOCK ARRANGEMENT FOR AN ELECTRICAL TERMINAL ENCLOSURE

[75] Inventor: Ernest G. Hoffman, Middlefield, Conn.

[73] Assignee: Harvey Hubbell, Incorporated, Orange, Conn.

[ * ] Notice: The portion of the term of this patent subsequent to Mar. 8, 1994, has been disclaimed.

[21] Appl. No.: 7,061

[22] Filed: Jan. 29, 1979

Related U.S. Application Data

[63] Continuation of Ser. No. 868,217, Jan. 9, 1978, abandoned, which is a continuation of Ser. No. 772,672, Feb. 28, 1977, Pat. No. 4,067,634, which is a continuation of Ser. No. 609,797, Sep. 2, 1975, Pat. No. 4,010,999.

[51] Int. Cl.[2] ..... H01R 13/58

[52] U.S. Cl. ..... 339/107; 174/88 R

[58] Field of Search ..... 339/107, 95 R, 97 R, 339/98, 99 R; 174/88 R, 138 F

[56] References Cited

U.S. PATENT DOCUMENTS 4,138,185 2/1979 Jaconette, Jr. ..... 339/107

FOREIGN PATENT DOCUMENTS 1394871 3/1965 France ..... 339/107

676144 7/1952 United Kingdom ..... 339/107

*Primary Examiner*—Roy Lake

*Assistant Examiner*—DeWalden W. Jones

*Attorney, Agent, or Firm*—Jerry M. Presson

[57] ABSTRACT

An interlock arrangement is disclosed for a unitary molded enclosure for electrical terminals such as for the terminals for a dead-front electrical plug. The enclosure is formed of electrically insulating material and has an interior chamber for housing the terminals and additionally has at least one moveable wall portion connected to the remainder of the enclosure by an integral web hinge. The moveable wall portion pivots on the hinge to an open position which provides access to the interior chamber of the enclosure. A number of interengaging locking members are integrally formed with the moveable wall and the remainder of the enclosure and engage one another when the moveable wall portion is closed to relieve stress on the hinge when assembling and using the enclosure and to provide safety even if the web hinge is weakened or fails. The unitary molded enclosure may have two such moveable walls, each with its own web hinge and interengaging locking members.

23 Claims, 10 Drawing Figures

INTERLOCK ARRANGEMENT FOR AN ELECTRICAL TERMINAL ENCLOSURE

REFERENCE TO RELATED APPLICATION

This application is a continuation of application Ser. No. 868,217, filed Jan. 9, 1978, now abandoned, which is a continuation of patent application Ser. No. 772,672, filed Feb. 28, 1977, now U.S. Pat. No. 4,067,634, granted Jan. 10, 1978, which is in turn a continuation of patent application Ser. No. 609,797, filed Sept. 2, 1975, now U.S. Pat. No. 4,010,999, granted Mar. 8, 1977. All prior applications are hereby incorporated by reference in this continuation application.

BACKGROUND AND SUMMARY OF THE INVENTION

The invention relates to an interlock arrangement for a unitary molded enclosure for electrical terminals, such as for a dead-front electrical plug or connector. More specifically, the invention relates to an interlock arrangement formed of one or more locking members integrally formed with one or more moveable wall portions connected by a web hinge or web hinges to the remainder of the enclosure and interengaging locking members integrally formed with the remainder of the enclosure such that the interengaging locking members engage one another when the enclosure is folded or closed.

There have been some prior art proposals for electrical connector plugs which use web-hinged covers and suggest engagement of mating projections and recesses of the two hinged covers when the connector is assembled. See, for example, British Patent Specification No. 676144, published in 1952 and French Pat. No. 1394871, published in 1965. Other types of interengaging projections and recesses are suggested in U.S. Pat. Nos. Des.201,442; 3,576,518; 3,836,944; 3,856,376; 3,899,236 and 3,971,616.

An improved interlock arrangement is provided in accordance with this invention. In one embodiment the interlock arrangement is for a unitary molded enclosure for electrical terminals. The enclosure has at least one moveable wall portion joined by a web hinge to the remainder of the enclosure. The enclosure is made of an electrically insulating material and has an interior chamber for housing the electrical terminals. The web hinge joins one edge of the moveable wall portion to an adjoining surface of the enclosure to permit pivotal movement of the moveable wall portion on the web hinge to an open position which provides access to the interior chamber of the enclosure. There are locking means for releasably interlocking the moveable wall portion to the enclosure when the moveable wall portion is in a closed position, so as to relieve stress on the web hinge and to lock the wall portion against displacement both outwardly away from the enclosure and transverse to said outward direction. The locking means includes a number of interengaging locking members adjacent the web hinge, at least one being integral with the moveable wall portion and at least one being integral with an adjacent portion of the enclosure. These interengaging locking members engage one another at a location inwardly of the web hinge when the moveable wall portion is closed.

In another embodiment of the invention, the interlock arrangement is for a unitary molded enclosure for electrical terminals which has a number of integral web hinges each joining one edge of a respective moveable wall portion to an adjoining surface of the enclosure to permit pivotal movement of the respective moveable wall portion on its web hinge to an open position which provides access to the interior of the enclosure. There are locking means for each such moveable wall portion for releasably interlocking the moveable wall portion to the enclosure when it is in a closed position so as to relieve stress on the respective web hinge and to lock the wall portion in the area of the web hinge against displacement both outwardly away from the enclosure and transversely to said outward direction.

The invention provides an interlock arrangement for a unitary molded enclosure for electrical terminals which is particularly inexpensive to manufacture and particularly convenient to assemble and safe to use.

DETAILED DESCRIPTION

Figure 1:
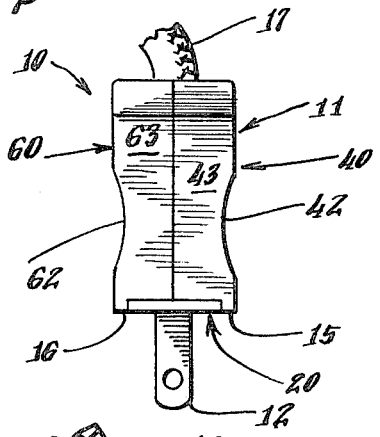
FIG. 1 is an end view of an electrical plug connector according to the invention herein.

In FIGS. 1–6 there is shown a one-piece dead-front electrical plug 10 of high strength, according to the invention herein. The dead-front electrical plug 10 comprises generally a plug body 11 and two power blades 12 and 13, and is adapted to make electrical connection between a cord 17 and a standard electrical socket outlet, not shown. The plug body 11 is generally comprised of a dead-front member 20 through which power blades 12 and 13 are mounted, and two side covers 40 and 60. The side covers 40 and 60 are hingedly connected to the dead-front member 20 by web hinges 15 and 16, and the entire plug body 11 is formed integrally of a high strength insulating material, such as nylon.

Referring now to FIGS. 3–6 in which the details of the structure of the dead-front electrical plug 10 are shown, the dead-front member 20 is comprised of a rectangular bottom plate 21 which forms a smooth base or front of the plug except for two elongated notch openings 22 and 23 located midway along the side edges of the bottom plate 21 adjacent to side covers 40 and 60, respectively. An upstanding flange 24 is provided about the rectangular periphery of the bottom plate 21. Two additional upstanding flanges 25 and 26 together with the peripheral flange 24 define two elongated grooves 27 and 28 which are parallel to the end edges of the bottom plate 21.

A block 30 is integrally formed with and upstands from the central inner area of the bottom plate 21, and a rectangular groove 31 is defined surrounding the sides of the block 30 between it and the flanges 24–26. The block 30 serves as a mounting and support member for the power blades 12 and 13, which are press fit into openings extending through the block 30 and the bottom plate 21 integral therewith. The upper terminal ends of the power blades 12 and 13 are provided with terminal screws 18 and 19 which are readily accessible when the dead-front electrical plug is in the open condition shown in FIGS. 5 and 6 for facilitating wire connections with wire conductors 32 and 33 of cord 17. An "H" shaped insulation barrier 34 is formed integrally with and upstanding from the block 30, and is positioned between the upper terminal ends of power blades 12 and 13.

Figure 4:
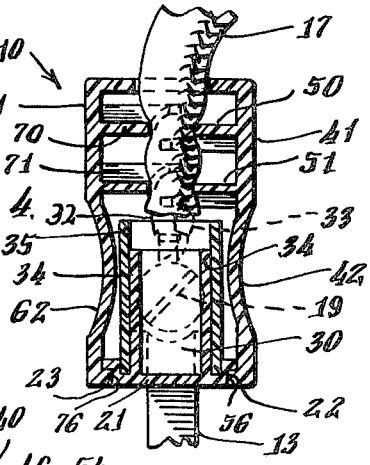
FIG. 4 is a sectional view of the electrical plug connector of FIG. 1 taken along lines 4—4 of FIG. 2.
Figure 5:
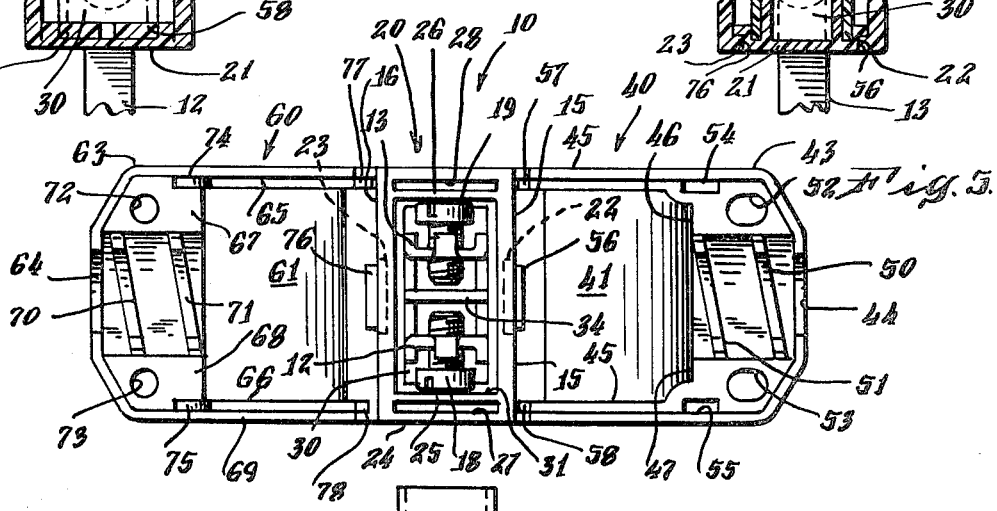
FIG. 5 is a top view of the electrical plug connector of FIG. 1 in its open condition.

Referring particularly to FIGS. 4 and 5, it will be noted that the rectangular groove 31 defined between the block 30 and the flanges 24–26 is adapted to receive the lower end of an optional rectangular sealing compound barrier sleeve 35. The sealing compound barrier sleeve 35 surrounds the upper ends of the power blades 12 and 13, their associated terminal screws 18 and 19, and any uninsulated or stripped portion of the wire conductors 32 and 33 adjacent to their connection to the terminal screws. The sealing compound barrier sleeve 35 is filled with a sealing or potting compound (not shown) which cures to provide a protective, fully moisture-proof wiring connection between the wire conductors and the power blades. Of course, the sealing compound barrier sleeve 35 and sealing compound may be omitted and are not necessary to the structure of the dead-front electrical plug 10, although they do provide additional safety and service features and are accordingly preferred.

Figure 6:
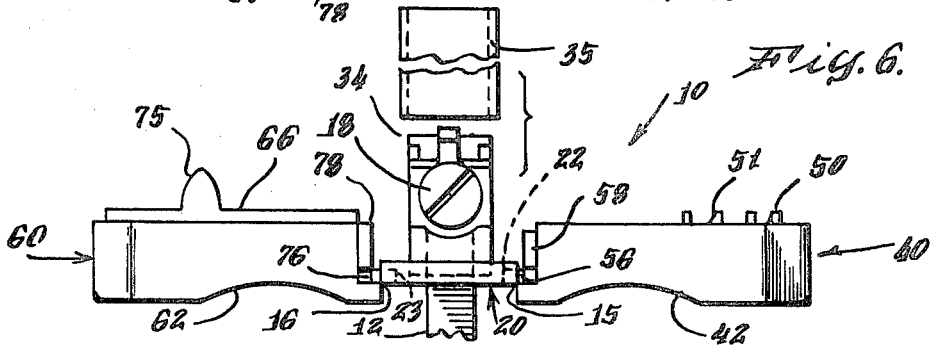
FIG. 6 is an end view of the electrical plug connector of FIG. 1 in its open condition.
Figure 7:
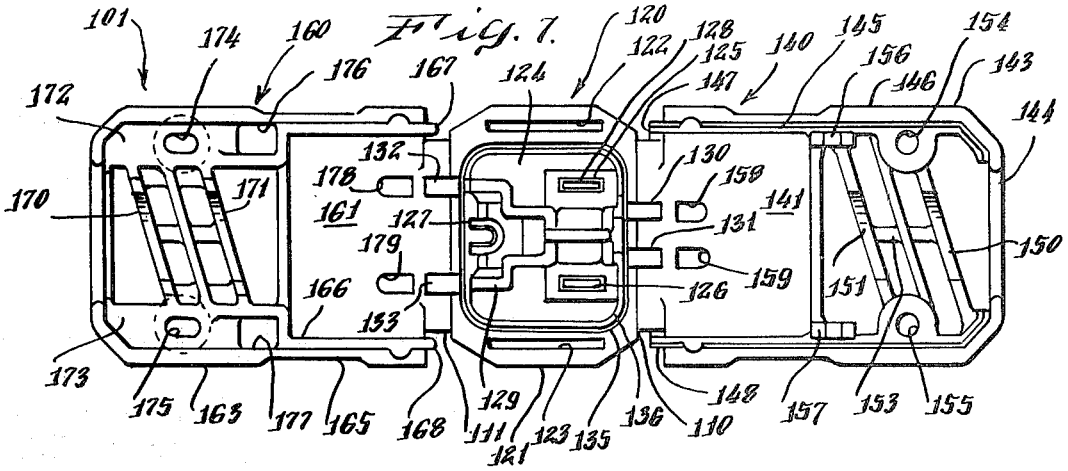
FIG. 7 is a top view of another electrical plub connector according to the invention herein in its open condition.

The plug body 11 of the dead-front electrical plug 10 further comprises side covers 40 and 60 which are integrally connected to the dead-front member 20 by means of web hinges 15 and 16, respectively. As best seen in FIGS. 5 and 6, web hinges 15 and 16 each comprise two thin, aligned, flexible webs which flank the notches 22 and 23 in the bottom plate 21 of the dead-front member 20 and extend between the bottom plate 21 and the side covers 40 and 60, wherein the side covers are pivotally mounted with respect to the dead-front member 20.

Figure 2:
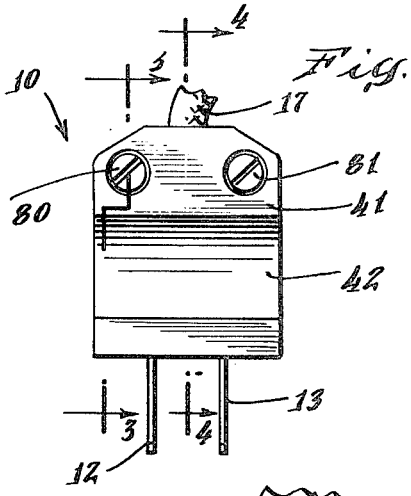
FIG. 2 is a front view of the electrical plug connector of FIG. 1.

The side cover 40 comprises a front panel 41, which, as viewed in FIG. 2, comprises the front of the dead-front electrical plug 10. A concave portion 42 of the front panel 41 cooperates with a similar concave portion 62 on panel 61 of side cover 60, which comprises the back of the electrical dead-front plug 10, as viewed in FIG. 2, to facilitate gripping the assembled plug for inserting it into and removing it from electrical socket outlets.

The side cover 40 further comprises a wall 43 which is generally perpendicular to and extends around three sides of the front panel 41. The wall 43 forms substantially one-half of the ends and top of the assembled dead-front electrical plug 10, as best seen in FIG. 1. In the portion of wall 43 which forms the top of the assembled dead-front electrical plug 10 there is defined a semi-circular opening 44 which accommodates the passage of cord 17.

The wall 43 further includes a shoulder 45 which extends about the inner periphery thereof except at the semi-circular opening 44. The shoulder 45 is partially defined by two blocks 46 and 47 which are also integral with the front panel 41. Two cord clamp teeth 50 and 51 upstand from the inner surface of front panel 41 and are integral with and diagonally disposed between the two blocks 46 and 47. The upper surfaces of the cord clamp teeth 50 and 51 are concave.

Figure 3:
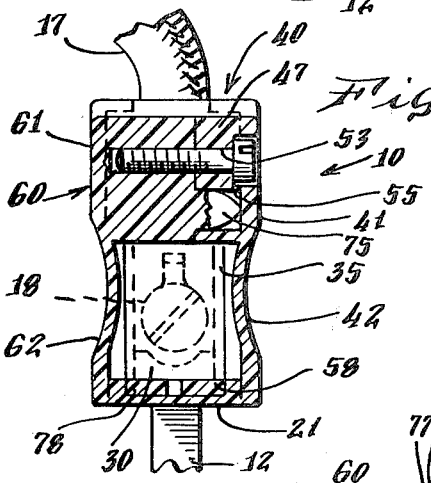
FIG. 3 is a sectional view of the electrical plug connector of FIG. 1 taken along the lines 3—3 of FIG. 2.

Two oblong openings 52 and 53 are formed through the blocks 46 and 47, respectively, and front panel 41 integral therewith, flanking the cord clamp teeth 50 and 51. The openings 52 and 53 are preferably countersunk adjacent to the front panel 41, as best seen in FIG. 3. Two additional rectangular openings 54 and 55 are formed partially through blocks 46 and 47, respectively, from the shoulder 45 of side wall 43.

The side cover 40 further comprises a rectangular flange 56 upstanding from the inner surface of front panel 41 between the two webs comprising the web hinge 15, and flange 56 is matingly received in the notch 22 formed in the dead-front member 20 when the dead-front electrical plug 10 is in its fully assembled condition, as best seen in FIG. 4. Two additional flanges 57 and 58 extend from the ends of wall 43, and are received in the grooves 27 and 28 of the dead-front member 20 when the dead-front electrical plug 10 is in its assembled condition, as best seen in FIG. 3.

As noted above, the side cover 60 is comprised of a back panel 61 having a concave portion 62. The side cover 60 is integrally hingedly connected to the dead-front member 20 by means of web hinge 16. A wall 63 upstands generally perpendicularly to the back panel 61 and extends around three sides thereof, and the wall 63 is shaped to cooperate with wall 43 of side cover 40 to form the ends and top of the assembled dead-front electrical plug 10. A semi-circular opening 64 is defined by the wall 63 opposite the opening 44 in wall 43 such that the two openings 44 and 64 together accommodate passage of the cord 17. Integral with the wall 63 along the inside edge thereof are two flanges 65 and 66 and two blocks 67 and 68. A shoulder 69 is formed along the outside of wall 63 adjacent to the flanges 65 and 66 and the blocks 67 and 68.

Two cord clamp teeth 70 and 71 upstand from the back panel 61 and are integral with and extend diagonally between the blocks 67 and 68. The upper surfaces of the cord clamp teeth 70 and 71 are concave, and it will be noted that the diagonal orientation of the cord clamp teeth 70 and 71 is opposite to that of cord clamp teeth 50 and 51 of side cover 40 such that the two sets of cord clamp teeth crisscross when the dead-front electrical plug 10 is in its assembled condition.

Two openings 72 and 73 are formed partially through the blocks 67 and 68, respectively, flanking the cord clamp teeth 70 and 71. Protruding upwardly from the flanges 65 and 66, respectively, are two prongs 74 and 75. Side cover 60 further comprises a flange 76 upstanding from the interior surface of the back panel 61 between the webs of web hinge 16 and juxtaposed the notch 23 in the dead-front member 20, and flange 76 is matingly received in notch 23 when the electrical dead-front plug 10 is in its assembled condition. Two additional flanges 77 and 78 are provided at the terminal ends of wall 63 and are received in grooves 26 and 27, respectively, as best seen in FIG. 3.

The dead-front electrical plug 10 is assembled by first stripping and connecting the ends of the two wire conductors 32 and 33 of cord 17 to the upper ends of the power blades 12 and 13 via terminal screws 18 and 19.

The sealing compound barrier sleeve 35 and sealing compound, if desired, are then placed over the wire connections. After wiring has been completed, the side covers 40 and 60 are pivoted together so that the electrical dead-front plug 10 is in the assembled condition illustrated in FIGS. 1–4. The flanges 65 and 66 of side cover 60 butt against the shoulder 45 of side cover 40 and lie inside the wall 43 thereof. Similarly, the upper portion of wall 43 fits tightly against shoulder 69. This overlapping engagement between side covers 40 and 60 provides for a dust free interior of the dead-front electrical plug 10 and makes it resistant to the insertion of foreign objects.

Top surfaces of blocks 46 and 47 butt against the top surfaces of blocks 67 and 68. The prongs 74 and 75 of side cover 60 are received in the openings 54 and 55 of side cover 40, and the interengagement therebetween keeps the side covers 40 and 60 in alignment as the cord clamp teeth 50, 51, 70 and 71 grip the cord 17, as best seen in FIG. 4, and thereby relieve any strain on the wiring connections. The through openings 52 and 53 formed in side cover 40 align with the partial openings 72 and 73 in blocks 67 and 68 formed in side cover 60, and two self-threading screws 80 and 81 are threaded into the openings to secure the side covers 40 and 60 together.

As noted above, the flanges 56 and 76 are respectively matingly received in the notches 22 and 23 of the dead-front member 20, and the resultant interengagement provides longitudinal strength between the side covers 40 and 60 and the dead-front member 20 of the plug 10. Thus, the cooperation of flanges 56 and 76 and notches 22 and 23 relieves any longitudinal stress which would otherwise be placed on the web hinges 15 and 16 when the side covers are gripped to remove the dead-front electrical plug from an electrical socket outlet. Similarly, the flanges 57 and 77 are received in the groove 28 in the dead-front member 20 and the flanges 58 and 78 are received in the groove 25 of the dead-front member 20 (as best seen in FIG. 3) to relieve any lateral stress extant between the side covers 40 and 60 and the dead-front member 20.

During assembly of the dead-front electrical plug 10, it may be desirable to add a rubber grommet (not shown) around the cord 17 between the semi-circular openings 44 and 64, and such grommet may be used alone or in addition to the sealing compound barrier sleeve 35 and sealing compound.

Thus, the dead-front electrical plug 10 achieves the safety advantages of dead-front type electrical plugs and yet is extremely easy to wire, is extremely strong in its assembled condition, and is dust-proof and moisture-proof.

Referring now to FIGS. 7–10, there is shown a second embodiment 100 of a dead-front electrical plug according to the invention herein. It generally comprises a plug body 101, shown alone in FIG. 7, two power blades 102 and 103, and a ground pin 104. The dead-front electrical plug 100 is adapted to make electrical connection between a cord 113 comprising three wire conductors 114–116 and a grounded electrical socket outlet, not shown. The plug body 101 of the dead-front electrical plug 100 is generally comprised of a dead-front member 120 and two side covers 140 and 160 which are hingedly connected thereto by web hinges 110 and 111. The entire plug body 101 is integrally formed of an insulating material, which may be nylon.

The dead-front member 120 of the plug body 101 comprises a base plate 121, the outer surface of which forms a smooth insulating face or front of the dead-front electrical plug 100. Two parallel grooves 122 and 123 are formed partially through the base plate 121 adjacent to the end edges thereof. A thicker central portion 124 of the dead-front member 120 is formed integrally with the base plate 121 thereof and serves as a supporting and mounting block for the power blades 102 and 103 and the ground pin 104. To this end two rectangular openings 125 and 126 and a U-shaped opening 127 are formed through the central portion 124 and integral base plate 121 to receive the power blades 102 and 103 and the ground pin 104, respectively. Each of the openings 125–127 is preferably provided with a sealing lip, e.g. sealing lip 128 of opening 125, which extends laterally into the opening adjacent the bottom surface of the base plate 121.

Figure 8:
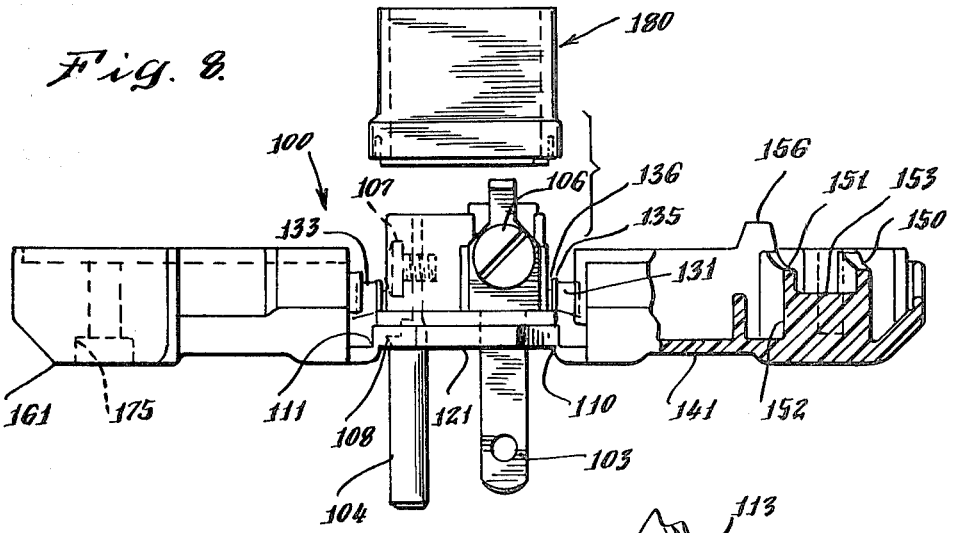
FIG. 8 is an end view of the electrical plug connector of FIG. 7 in its open position.

The power blades 102 and 103 and the ground pin 104 are pushed through the openings 125–127 and are retained therein by integral barbs, such as barb 108 of ground pin 104, best seen in FIG. 8. The upper ends of the power blades 102 and 103 and the ground pin 104 are provided with terminal screws 105–107, respectively, for making wiring connections with the three wire conductors 114–116 of cord 113. An insulation barrier 129 is integral with and upstanding from the central portion 124 of the dead-front member 120 and serves to isolate the power blades 102 and 103, the ground pin 104, and their associated terminal screws and any adjacent uninsulated portion of the wire conductors from each other.

Two dowel pins 130 and 131 protrude laterally from one side of the dead-front member 120. More particularly, the dowel pins 130 and 131 are positioned between the power blades 102 and 103, and are integral with the top of the thick central portion 124 and the insulation barrier 129 of the dead-front member 120. Two additional dowel pins 132 and 133 protrude laterally from the opposite side edge of the dead-front member 120, and dowel pins 132 and 133 are also integral with the thick central portion 124 and the insulation barrier 129. The dowel pins 132 and 133 flank the upper end of the ground pin 104 and its associated terminal screw 107. The dead-front member 120 further comprises a circumferential flange 135 and an associated groove 136 formed between it and the thick central portion 124. The flange 135 and groove 136 extend about the periphery of the thick central portion 124, and are elevated to pass over the dowel pins 130–133.

The side cover 140 comprises a panel 141, which forms the back of the assembled dead-front electric plug 100 as viewed in FIG. 4. Web hinge 110 comprises a thin web of the plug material which is integral with both the back panel 141 and the dead-front member 120, and thereby hingedly connects it with the side cover 140.

A U-shaped wall 143 upstands generally perpendicularly from the periphery of back panel 141 around three sides thereof to form substantially one-half of the top and ends of the assembled dead-front electrical plug 100. The wall 143 defines a semi-circular opening 144 which accommodates the passage of cord 113 and a surrounding sealing grommet 109. The upper edge of the wall 143 includes a flange 145 along the inside thereof, and a shoulder 146 is defined adjacent to the flange 145 along the outside of wall 143. The flange 145 is contiguous with two additional flanges 147 and 148 which protrude laterally from the ends of wall 143 as viewed in FIGS. 7 and 8, in alignment with the grooves 122 and 123, respectively, of the dead-front member 120.

Two parallel cord clamp teeth 150 and 151 are diagonally disposed between the legs of U-shaped wall 143 adjacent to the semi-circular opening 144. The cord clamp teeth 150 and 151 are integral with a thickened portion 152 of the back panel 141, and strengthening ribs 153 may also be provided in connection with the cord clamp teeth. Two openings 154 and 155 are formed partially through the side cover 140 in thickened surrounding portions of the wall 143, flanking the cord clamp teeth 150 and 151. Two prongs 156 and 157 are formed extending upwardly from the opposite legs of the U-shaped wall 143.

Figure 9:
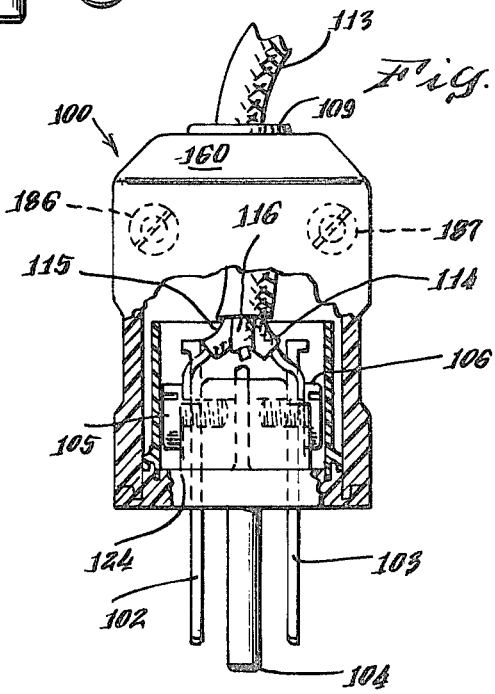
FIG. 9 is a front view, partially cut away, of the electrical plug connector of FIG. 7 in its closed position.

The back panel 141 of side cover 140 is provided with two openings 158 and 159 which matingly receive the dowel pins 130 and 131 when the dead-front electrical plug 100 is in its assembled condition shown in FIG. 9.

Side cover 160 is similar to side cover 140, and comprises a panel 161 which forms the front of the assembled dead-front electrical plug as viewed in FIG. 9. The side cover 160 is hingedly connected to the dead-front member 120 by means of web hinge 111. An upstanding U-shaped wall 163 extends around three sides of the back panel 160, and the wall 163 forms substantially the other half of the top and ends of the assembled dead-front electrical plug 100. The wall 163 defines a semi-circular opening 164 which cooperates with the opening 144 in wall 143 to accommodate passage of the cord 113 and its associated grommet 109. The upper edge of wall 163 terminates in a flange 165 and a shoulder 166, the flange 165 being disposed on the outside of the wall 143 and the shoulder 166 being located on the inside immediately adjacent thereto. Two additional flanges 167 and 168 protrude laterally from the ends of the U-shaped wall 163 as viewed in FIGS. 7 and 8, and are in alignment with the grooves 122 and 123, respectively, of the dead-front member 120.

Two parallel cord clamp teeth 170 and 171 are diagonally disposed between two blocks 172 and 173, the blocks 172 and 173 being integral with both the wall 163 and front panel 161 of side cover 160. The cord clamp teeth 170 and 171 are oppositely diagonally disposed to the cord clamp teeth 150 and 151 of side cover 140 such that the two sets of cord clamp teeth crisscross when dead-front electrical plug 100 is assembled. Two openings 174 and 175 are formed in the blocks 172 and 173 respectively, and the openings 175 and 176 are countersunk into the outside surface of front panel 161, as best seen in FIG. 8. Two additional openings 176 and 177 are formed in the blocks 172 and 173, respectively, adjacent to the legs of the U-shaped wall 163. The front panel 161 defines an additional two openings 178 and 179 which receive the dowel pins 132 and 133 when the electrical dead-front plug 100 is assembled.

The dead-front electrical plug 100 is assembled by first connecting the wire conductors 114–116 of cord 113 to the power blades 102 and 103 and the ground pin 104 via the terminal screws 105–107. The wiring connections are easily made with the dead-front electrical plug 100 in the open condition shown in FIG. 8.

Figure 10:
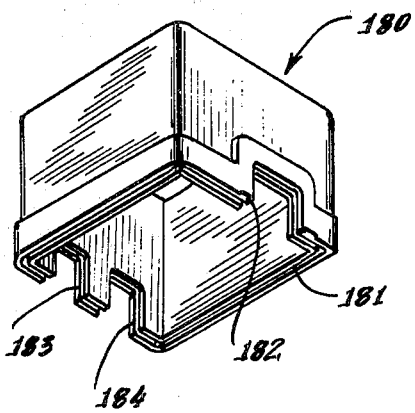
FIG. 10 is a perspective view of a sealing compound barrier for the electrical plug connector of FIG. 7.

An optional, generally rectangular sealing compound barrier sleeve 180, shown in FIG. 10, is fitted over and surrounds the upper ends of the power blades, ground pin and the wiring connections thereto. The sealing compound barrier sleeve has a groove 181 formed in its lower edge, and the groove 181 receives the circumferential flange 135 of the dead-front member 120. The inside edge of the sealing compound barrier sleeve 180 is notched at 182, 183 and 184, and notch 182 fits over the more closely spaced dowel pins 130 and 131. The notches 183 and 184 fit over the other more widely spaced dowel pins 132 and 133. A sealing compound (not shown) is placed in the sealing compound barrier sleeve 180, and in this regard it should be noted that the sealing lips such as sealing lip 128 in the opening 125 for power blade 102, prevent any sealing compound from leaking through the dead-front member 120 around the power blades or ground pin.

The side covers 140 and 160 are pivoted together about the web hinges 110 and 111. It will be noted that the side covers 140 and 160 are similarly shaped and fit together to form a smooth exterior of the dead-front electrical plug 100. In particular, the flange 145 and shoulder 146 of side cover 140 interlock with the flange 165 and shoulder 16 of side cover 160 to provide a relatively dust-proof joint which also protects against the insertion of foreign objects into the wiring area.

The prongs 156 and 157 of side cover 140 are received in the openings 176 and 177, respectively, of side cover 160, and the prongs thereby maintain the side covers in alignment against misaligning forces created as the cord 113 is clamped between the crisscorssed cord clamp teeth 150, 151, 170 and 171. The dowel pins 130–133 fit snugly into the openings 158, 159, 178 and 179 in the side covers. This interengagement between the dowel pins and the side covers bears any longitudinal forces exerted between the side covers and dead-front member 120, such as those created in pulling the dead-front electrical plug 100 from an electrical socket outlet, and relieve what would otherwise be a stress on the web hinges 110–111. The flanges 148 and 168 fit into the groove 123 in the dead-front member 120, and the flanges 147 and 167 fit into the other groove 122 formed in the dead-front member 120. The interengagement between flanges 147, 148, 167 and 168 and grooves 122 and 123 bears any lateral forces created between the side covers and the dead-front member 120, thus completing full stress protection of the web hinges 110 and 111. The covers are secured together by self-tapping screws 186 and 187 which are inserted through the openings 174 and 175 in side cover 160 and are threaded into the openings 154 and 155 in side cover 140.

Thus, the invented arrangement provides an interlocking action which permits an easy and convenient access to the interior of the connector housing when the side covers are open, and yet securely maintains the side cover, and particularly their front ends, locked to the dead-front member. The invented arrangement relieves stress on the web hinges, and resists displacement in any direction of the side covers, and particularly their front ends, relative to the dead-front base.

I claim:

1. An interlock arrangement for a unitary molded enclosure for electrical terminals having portions thereof which are in fixed relationship to said terminals and at least one movable wall portion joined by a web hinge to the remainder of the enclosure, comprising an enclosure formed of electrical insulating material having an interior chamber for housing electrical terminals, and having portions thereof which are in fixed relationship to said terminals and at least one movable wall portion;

an intergral web hinge joining one edge of said movable wall portion to an adjoining surface of a fixed portion of said enclosure to permit pivotal movement of said movable wall portion on said web hinge to an open position which provides access to the interior chamber of said enclosure;

locking means for releasably interlocking the movable wall portion to the enclosure when said movable wall portion is in a closed position, to relieve stress on the web hinge and to lock it against displacement both outwardly away from said enclosure and transverse to said outward direction;

said locking means including a plurality of interengaging locking members adjacent the web hinge, one integral with the movable wall portion and one integral with an adjacent fixed portion of the enclosure; and said interengaging locking members engaging one another at a location inwardly of the web hinge when the movable wall portion is closed, and substantially in the transverse plane of said web hinge, to directly oppose any outward force on said web hinge.

2. The interlock arrangement according to claim 1 wherein said interlocking members engage one another in a plane which passes through the web hinge and is substantially perpendicular to the plane of the outer surface of said movable wall portion.

3. The interlock arrangement according to claim 1 wherein said locking means includes a second plurality of interengaging locking members, one on the movable wall portion and one on an adjacent fixed portion of the enclosure;

one plurality of locking members locking said movable wall portion against outward displacement away from said enclosure and the other plurality of locking members locking said movable wall portion against displacement transverse thereto.

4. The interlock arrangement according to claim 1 wherein the interengaging locking members include a projection and a cooperating recess, one on the surface of the movable wall portion and the other on the adjacent fixed portion of the enclosure, and wherein, when said movable wall portion is in a closed position, said projection extends into said recess and releasingly retains said movable wall portion in said closed position.

5. The interlock arrangement according to claim 4 wherein said locking means includes a second plurality of interengaging locking members formed by a projection and a cooperating recess, one on the surface of the movable wall portion and the other on an adjacent fixed portion of the enclosure, and wherein, when said movable wall portion is in a closed position, the projection of the second plurality extends into its cooperating recess and releasingly retains said wall portion in a closed position.

6. The interlock arrangement according to claim 1 wherein the interengaging locking member integral with an adjacent fixed portion of the enclosure is located on a wall of the enclosure which extends substantially perpendicularly to the movable wall portion when the latter is in a closed position.

7. The interlock arrangement according to claim 1 wherein as the movable wall portion is closing the interengaging locking member integral with the movable wall portion moves, in a pivotal movement about the web hinge, toward and into engagement with the other interengaging locking member.

8. The interlock arrangement of claim 7 wherein the interlocking engaging members include at least one projection extending from the surface of the movable wall portion, and at least one cooperating recess formed in an adjacent fixed portion of the enclosure, and wherein, as the movable wall portion is closing, such projection moves in a pivotal movement about the web hinge to pass snugly into said cooperating recess to provide a releasable locking retention between the movable wall portion and the remainder of the enclosure.

9. The interlock arrangement according to claim 1 further including additional locking means carried by said movable wall portion at a location remote from the integral web hinge.

10. An interlock arrangement for a unitary molded enclosure for electrical terminals having at least one movable wall portion joined by a web hinge to the remainder of the enclosure, comprising an enclosure having a plurality of walls formed of electrical insulating material, the walls surrounding an interior chamber for housing electrical terminals and at least one of said walls being movable to an open position to provide access to said interior chamber;

an integral web hinge joining one edge of said movable wall to an adjoining fixed surface of said enclosure to permit pivotal movement of said movable wall on said web hinge to said open position;

locking means for releasably interlocking the movable wall to a fixed portion of the enclosure when said movable wall is in a closed position, to relieve stress on the web hinge and to lock it against displacement both outwardly away from said enclosure and transverse to said outward direction;

said locking means including a first plurality of interengaging locking members adjacent the web hinge, one integral with the movable wall and one integral with an adjacent fixed portion of the enclosure, and a second plurality of interengaging locking members one of which is integral with the movable wall and the other of which is integral with an adjacent fixed portion of the enclosure; and one of said plurality of locking members locking said movable wall against outward displacement away from said enclosure and the other of said plurality locking said movable wall against displacement transverse thereto.

11. The interlock arrangement of claim 10 wherein the interengaging locking members of the first plurality engage one another at a location inwardly of the web hinge when the movable wall is closed and lock said movable wall against outward displacement away from said enclosure.

12. An interlock arrangement for a unitary molded enclosure for electrical terminals having a plurality of movable wall portions each joined by a web hinge to the remainder of the enclosure, comprising an enclosure formed of electrical insulating material having an interior chamber for housing electrical terminals and a plurality of movable wall portions;

a plurality of integral web hinges each joining one edge of one of said movable wall portions to an adjoining fixed surface of said enclosure to permit pivotal movement of each movable wall portion on its associated web hinge to an open position to provide access to the interior of said enclosure;

locking means for each such movable wall portion for releasably interlocking each movable wall portion to a fixed portion of the enclosure when it is in a closed position, to relieve stress on its associated web hinge and to lock the wall portion in the area of the web hinge against displacement both outwardly away from said enclosure and transverse to said outward direction;

each said locking means including a set of interengaging locking members, one integral with a movable wall portion and one integral with an adjacent fixed portion of the enclosure; and the interengaging locking members of each set engaging one another at a location inwardly of the web hinge when their associated movable wall portion is closed.

13. The interlock arrangement of claim 12 wherein the locking means for each movable wall portion includes at least a first and second plurality of interengaging locking members, one locking member of each such plurality being integral with the movable wall portion and another integral with an adjacent fixed portion of the enclosure; and at least one of said plurality of locking members for each movable wall portion being located adjacent the web hinge of the movable wall portion, and the locking members of said one plurality engaging one another inwardly of the web hinge.

14. An interlock arrangement for a unitary molded enclosure for electrical terminations having two movable wall portions and a fixed wall portion with an exterior face containing apertures for the passage of conductive contact members to said terminations, the enclosure formed of an electrical insulating material and having a longitudinal axis, comprising:

two integral web hinges each joining one edge of one of said movable wall portions to said fixed wall portion, to permit movement of said movable wall portions on said web hinges fron an open position to a closed position, the closed position being longitudinal and the open position being transverse thereto and providing access to the terminations within the enclosure;

support means interior of the enclosure and attached to said fixed wall portion for supporting the electrical terminations whether the movable wall portions are in the open or the closed position;

a first shoulder member on each of said movable wall portions and a second shoulder member on said fixed wall portion for each of said first shoulder members, said first and second shoulder members each having surface portions in close proximity and in longitudinal overlapping relationship when the movable wall portions are in the closed position; and the surface portion of each first shoulder member being located closer to its associated web hinge than the surface portion of said second shoulder member, whereby said first and second shoulder members restrain displacement of said movable wall portions relative to said fixed wall portion in a direction substantially parallel to the longitudinal axis and away from said web hinges.

15. The arrangement according to claim 14 wherein the web hinges are located substantially in the plane of said exterior face, and the surface portions of the first and second shoulder members are substantially parallel to the plane of said exterior face.

16. The arrangement according to claim 14 wherein the surface portion of each of said second shoulder members is a projection extending laterally from said support means substantially perpendicular to the longitudinal axis.

17. The arrangement according to claim 14 and further comprising a third shoulder on each of said movable wall portions and a fourth shoulder on said fixed wall portion for each of said third shoulders, the respective third and fourth shoulders being in close proximity to each other and in longitudinal overlapping relationship when the movable wall portions are in the closed position, each of said fourth shoulders being closer to its associated web hinge than the third shoulder, when the movable wall portions are closed, to restrain longitudinal displacement of said movable wall portions relative to said fixed wall portion in a direction toward said web hinges.

18. The arrangement according to claim 17 wherein said first and third shoulders are formed as unitary parts of the movable wall portions.

19. The arrangement according to claim 17 wherein the first and third shoulders on each of said movable wall portions comprise opposite walls of a recess in said movable wall portion.

20. An interlock arrangement for a unitary molded enclosure for electrical terminations having at least one movable wall portion and a fixed wall portion with an exterior face containing apertures for the passage of conductive contact members to said terminations, the enclosure formed of an electrical insulating material and having a longitudinal axis, comprising:

an integral web hinge joining one edge of said movable wall portion to said fixed wall portion, to permit movement of said movable wall portion on said web hinge from an open position to a closed position, the closed position being generally parallel to said longitudinal axis and the open position being transverse thereto and providing access to the terminations within the enclosure;

support means interior of the enclosure and attached to said fixed wall portion for supporting the electrical terminations whether the movable wall portion is in the open or the closed position;

means for maintaining said movable wall portion in a closed position enclosing said terminations;

a first shoulder member on the movable wall portion and a second shoulder member on said fixed wall portion, said first and second shoulder members having portions in close proximity and in longitudinal overlapping relationship when the movable wall portion is in the closed position; and the shoulder of said first shoulder member being located closer to said web hinge than the shoulder of said second shoulder member, whereby said shoulder members restrain displacement of said movable wall portion relative to said fixed wall portion in a direction substantially parallel to the longitudinal axis and away from said web hinge.

21. An interlock arrangement for a unitary molded enclosure for electrical terminations having two movable wall portions and a fixed wall portion with an exterior face containing apertures for the passage of conductive contact members to said terminations, the enclosure formed of an electrical insulating material and having a longitudinal axis, comprising:

two integral web hinges each joining one edge of one of said movable wall portions to said fixed wall portion, to permit movement of said movable wall portions on said web hinges from an open position to a closed position, the closed position being longitudinal and the open position being transverse thereto and providing access to the terminations within the enclosure;

support means interior of the enclosure and attached to said fixed wall portion for supporting the electrical terminations whether the movable wall portions are in an open or closed position;

a first shoulder member on each of said movable wall portions located adjacent a different one of the web hinges and a second shoulder member on said fixed wall portion inwardly of a different one of the web hinges for each of said first shoulder members, said first and second shoulder members having surface portions in close proximity and in overlapping relationship laterally of said longitudinal axis when the movable wall portions are in the closed position; and the surface portion of each second shoulder member being located closer to its associated web hinge than the surface portion of said first shoulder member, whereby said first and second shoulder members restrain displacement of said movable wall portions relative to said fixed wall portion at the web hinges in a direction laterally of the longitudinal axis and outwardly from said web hinges.

22. The arrangement according to claim 21 and further comprising means for maintaining said movable wall portions in a closed position enclosing said terminations.

23. An interlock arrangement for a unitary molded enclosure for electrical terminations having at least one movable wall portion and a fixed wall portion with an exterior face containing apertures for the passage of conductive contact members to said terminations, the enclosure formed of an electrical insulating material and having a longitudinal axis, comprising:

an integral web hinge joining one edge of said movable wall portion to said fixed wall portion, to permit movement of said movable wall portion on said web hinge from an open position to a closed position, the closed position being generally parallel to said longitudinal axis and the open position being transverse thereto and providing access to the terminations within the enclosure;

support means interior of the enclosure and attached to said fixed wall portion for supporting the electrical terminations whether the movable wall portion is in the open or the closed position;

a first shoulder member on the movable wall portion and a second shoulder member on said fixed wall portion located between said web hinge and the terminations and inwardly of said web hinge, said first and second shoulder members having portions in close proximity and in overlapping relationship substantially perpendicular to said longitudinal axis when the movable wall portion is in the closed position;

the shoulder of said second shoulder member being located closer to said web hinge than the shoulder of said first shoulder member, whereby said shoulder members restrain displacement of said movable wall portion relative to said fixed wall portion in a direction substantially perpendicular to the longitudinal axis and away from said web hinge; and means for maintaining said movable wall portion in a closed position enclosing said terminations.

* * * * *